US006881002B2

(12) United States Patent
Fatemi

(10) Patent No.: US 6,881,002 B2
(45) Date of Patent: Apr. 19, 2005

(54) SPREAD-STYLE COUPLER

(75) Inventor: Ray S. Fatemi, Fairlawn, OH (US)

(73) Assignee: JRB Attachments, LLC, Akron, OH (US)

( * ) Notice: Subject to any disclaimer, the term of this patent is extended or adjusted under 35 U.S.C. 154(b) by 5 days.

(21) Appl. No.: 10/305,610

(22) Filed: Nov. 27, 2002

(65) Prior Publication Data

US 2003/0099507 A1 May 29, 2003

Related U.S. Application Data

(60) Provisional application No. 60/333,989, filed on Nov. 29, 2001, and provisional application No. 60/405,398, filed on Aug. 23, 2002.

(51) Int. Cl.[7] ..... F16D 1/00

(52) U.S. Cl. ..... 403/322.3; 37/468; 172/681; 172/793

(58) Field of Search ..... 403/322.1, 322.2, 403/322.3, 325, 37, 38, 31; 37/468; 172/681, 793

(56) References Cited

U.S. PATENT DOCUMENTS 5,082,389 A * 1/1992 Balemi ..... 403/322.3
6,132,131 A 10/2000 Nakamura et al.
6,233,852 B1 5/2001 Pemberton
6,379,075 B1 * 4/2002 Shamblin et al. ..... 403/322.1
2001/0050326 A1 12/2001 Muroto
2002/0136597 A1 * 9/2002 Nishikawa et al. ..... 403/322.3

FOREIGN PATENT DOCUMENTS

| | | |
|---|---|---|
| EP | 0 139 040 A1 | 9/2000 |
| JP | 11-181818 | 7/1999 |
| JP | 2000248752 | 9/2000 |
| WO | WO 01/81682 A1 | 11/2001 |

* cited by examiner

*Primary Examiner*—John R. Cottingham
(74) *Attorney, Agent, or Firm*—Fay, Sharpe, Fagan, Minnich & McKee, LLP

(57) ABSTRACT

A coupler includes first and second spaced-apart ribs each defining first and second bores. The first bore of the first rib is aligned with the first bore of the second rib on a first pin-on axis, and the second bore of the first rib aligned with the second bore of the second rib on a second pin-on axis. A first hook assembly includes a first hook adapted to receive a first associated attachment pin. The first hook assembly is fixed relative to the first and second ribs. A second hook assembly includes a second hook adapted to receive a second associated attachment pin. The second hook assembly is selectively pivotable relative to the first and second ribs toward and away from the first hook assembly. An actuator is operatively connected to the second hook assembly to pivot the second hook assembly selectively relative to the first and second ribs.

17 Claims, 16 Drawing Sheets

SPREAD-STYLE COUPLER

CROSS-REFERENCE TO RELATED APPLICATION

This application claims priority from and benefit of the filing date of both U.S. provisional application No. 60/333,989 filed Nov. 29, 2001 and U.S. provisional application No. 60/405,398 filed Aug. 23, 2002.

BACKGROUND OF THE INVENTION

The present invention relates to couplers used to secure attachments such as buckets, air-operated hammers, shears, etc. fixedly and operatively to the distal end of a arm of a tractor, backhoe, excavator or other type of arm-equipped construction/agricultural equipment. As is generally well known, couplers are used as an alternative to a pin-on connection for fixedly and operatively securing an implement to the distal end of an arm which is, in turn, secured to a boom of a construction/agricultural machine such as a backhoe or excavator.

Spread-style couplers are generally known. These couplers are connected to an arm by a pin-on connection at a first pivot point and are connected to a control link by a pin-on connection at a second pivot point. These prior couplers include front and rear hooks that open in respective opposite directions oriented outwardly away from each other. Each hook is pivotably connected to the body of the coupler, i.e., each hook pivots about a separate axis. In use, the hooks are collapsed toward each other are placed between front (first) and rear (second) pins of a bucket or other attachment and the hooks are then spread-apart from each other, using a screw jack or other means. Upon being spread sufficiently far apart, the rear hook engages the rear pin of the implement and the front hook engages the front pin of the implement which results in the implement being operatively connected to the arm.

Known spread-style couplers are deficient for many reasons. One notable disadvantage of known spread-style couplers is that both hooks pivot relative to the coupler body. This results in an excessive amount of pivot points and reduces the strength of the coupler. Similarly, during digging and other operations, large loads are exerted upon the rear hook (inwardly located toward the boom-equipped machine) and the pivotable nature of this hook is not a desirable trait to encounter these large loads. Another deficiency of these known couplers results from the fact that the pivot points of the hooks are not coincident with the pivot points where the coupler is pinned to the arm and control link.

In light of the foregoing, a need has been identified for a new and improved spread-style coupler that overcomes the foregoing deficiencies and others while providing better overall results.

SUMMARY OF THE INVENTION

In accordance with a first aspect of the present invention, a coupler comprises first and second spaced-apart ribs each defining first and second bores. The first bore of the first rib is aligned with the first bore of the second rib on a first pin-on axis, and the second bore of the first rib aligned with the second bore of the second rib on a second pin-on axis. A first hook assembly includes a first hook adapted to receive a first associated attachment pin. The first hook assembly is fixed relative to the first and second ribs. A second hook assembly includes a second hook adapted to receive a second associated attachment pin. The second hook assembly is selectively pivotable relative to the first and second ribs toward and away from the first hook assembly. An actuator is operatively connected to the second hook assembly to pivot the second hook assembly selectively relative to the first and second ribs.

In accordance with another aspect of the present invention, a method of operatively connecting an attachment to a coupler comprises inserting a first attachment pin into a first hook of the coupler and pivoting the coupler about the first attachment pin until a second attachment pin is aligned with a second hook of the coupler. The second hook is then pivoted away from the first hook about a pivot axis until said first and second attachment pins are fully seated in the first and second hooks, respectively. The pivot axis is coincident with a pin-on axis about which the coupler pivots relative to a control link to which the coupler is connected.

In accordance with another aspect of the present invention, a coupler comprises an upper portion defining a first pin-on axis and a second pin-on axis. The coupler further comprises a first hook assembly including a first hook adapted to receive a first associated attachment pin. The coupler further comprises a second hook assembly including a second hook adapted to receive a second associated attachment pin. The second hook assembly is pivotably connected to the upper portion and selectively pivotable about the first or second pin-on axis toward and away from the first hook assembly. An actuator is operatively connected to the second hook assembly to pivot the second hook assembly.

BRIEF DESCRIPTION OF THE DRAWINGS

The invention comprises various components and arrangements of components, preferred embodiments of which are illustrated in the accompanying drawings that form a part hereof and wherein.

DETAILED DESCRIPTION OF PREFERRED EMBODIMENTS

Figure 1:
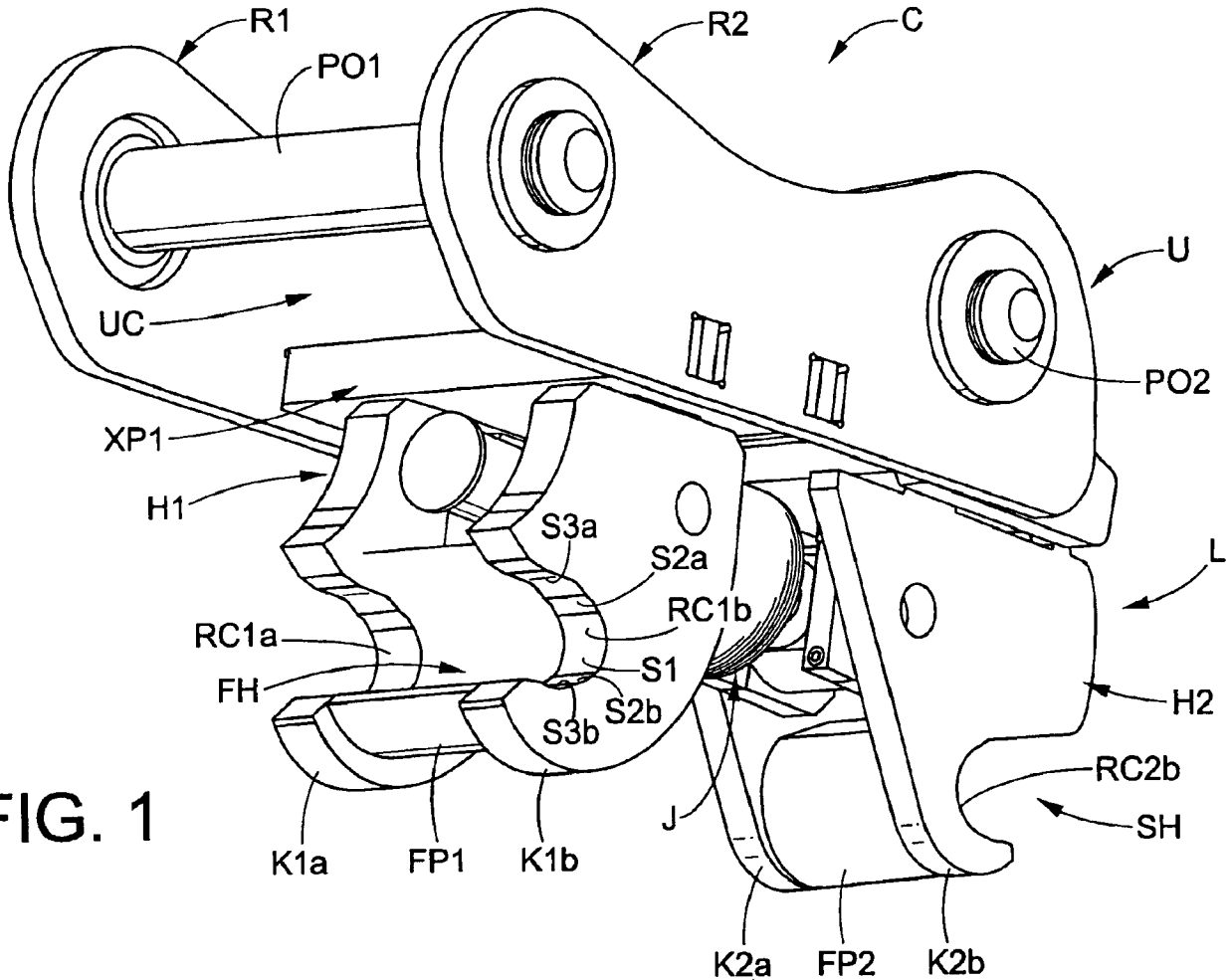
FIG. 1 is a first isometric view of a coupler formed in accordance with the present invention.
Figure 2:
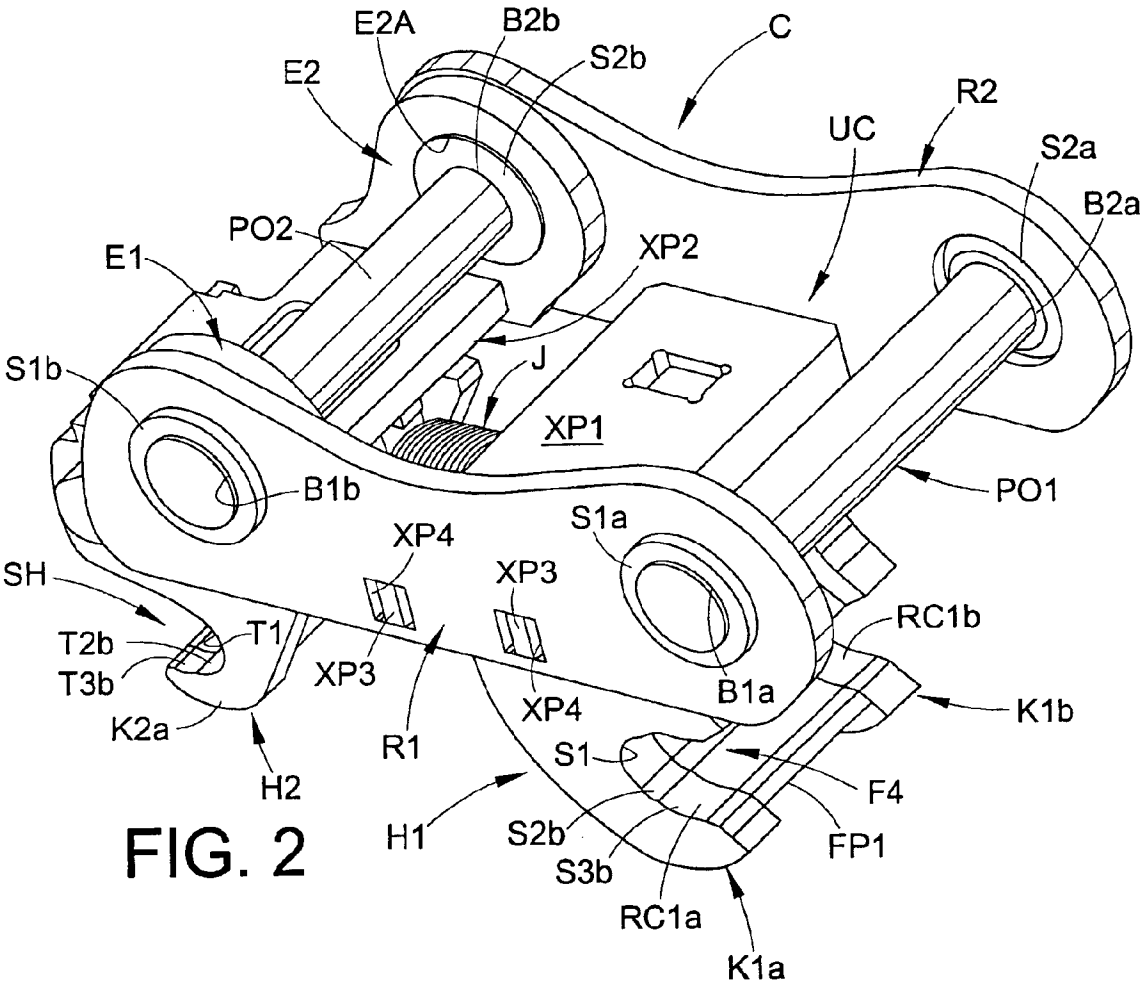
FIG. 2 is a second isometric view of the coupler illustrated in FIG. 1.
Figure 3:
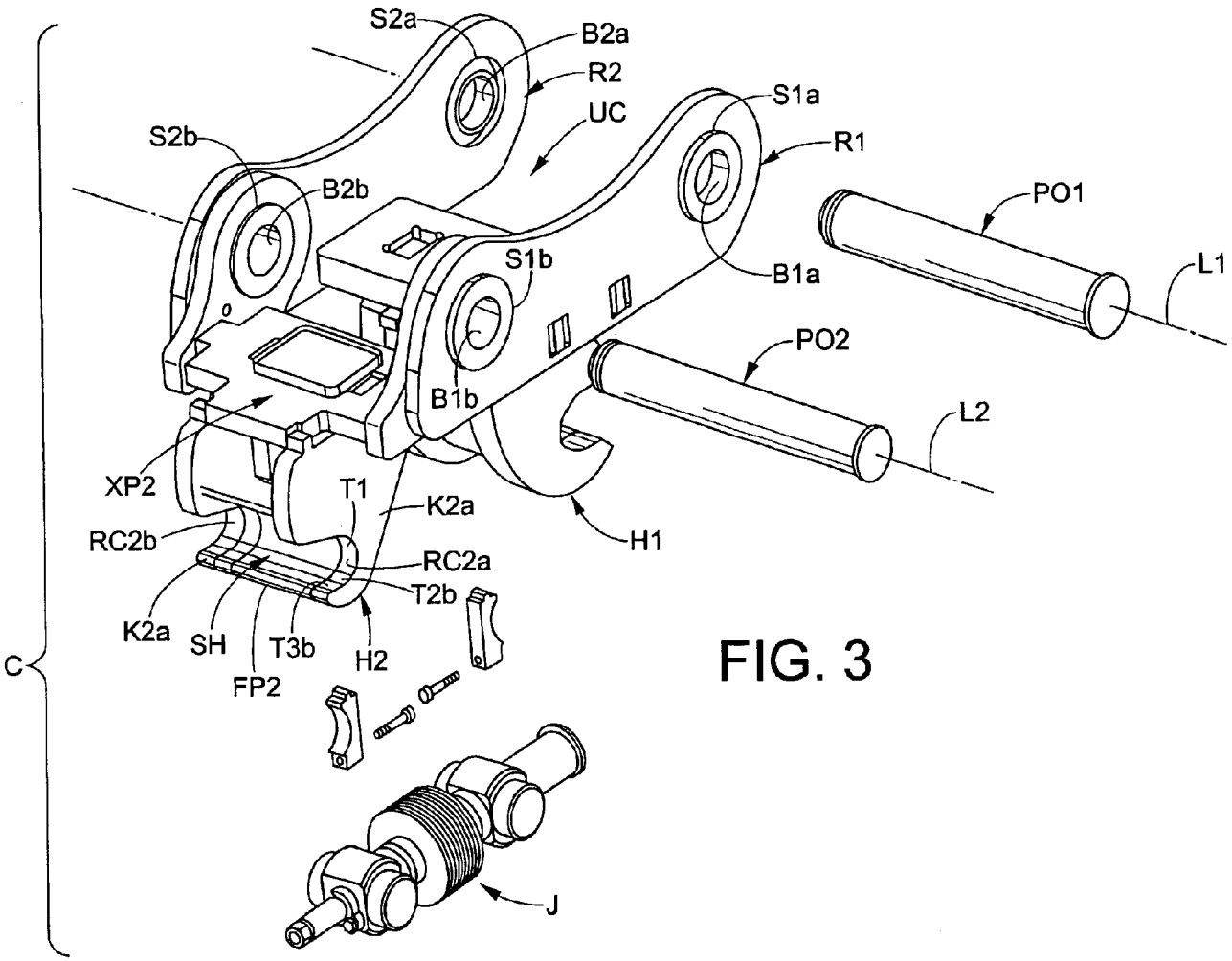
FIG. 3 is an exploded isometric view of the coupler shown in FIGS. 1 & 2.
Figure 4:
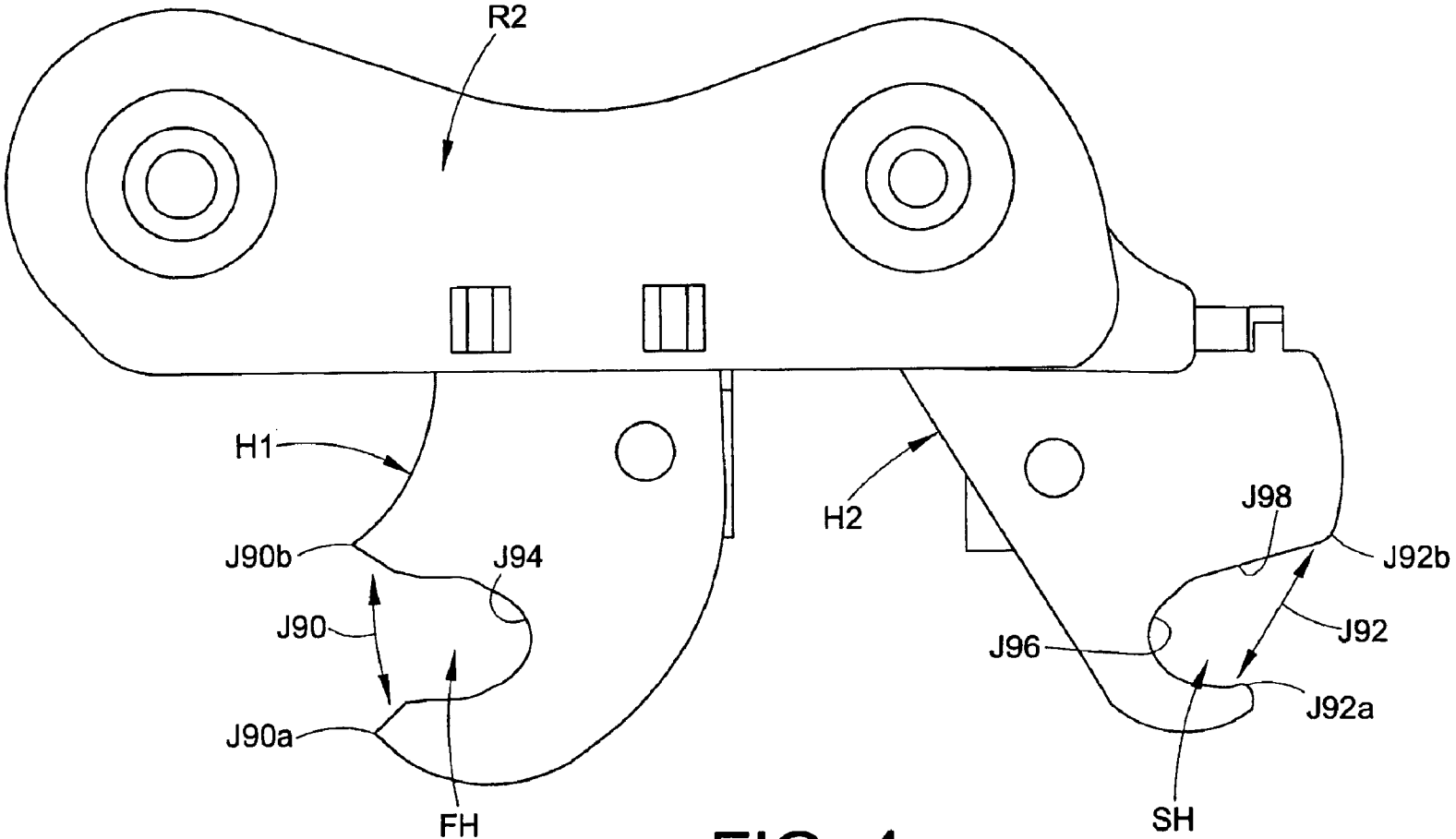
FIG. 4 is a side view of the coupler shown in FIGS. 1 & 2 with the screw jack assembly removed.
Figure 5:
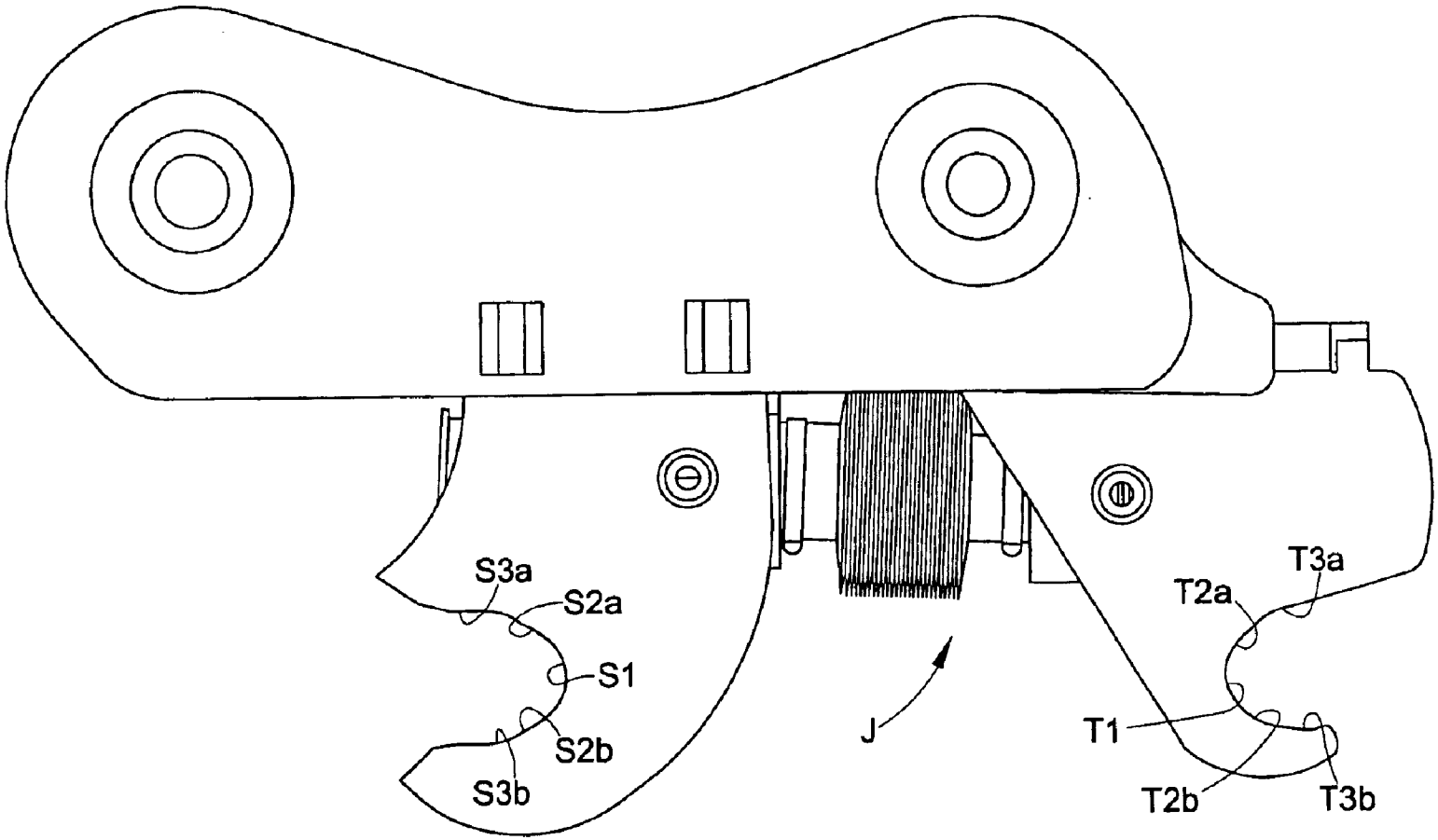
FIG. 5 is a fully assembled side view of the coupler shown in FIGS. 1 & 2.

Referring initially to FIGS. 1–3, a coupler C formed in accordance with the present invention comprises two main sections: (i) an upper section U configured or adapted for pivotable pin-on connection to an arm and control link of an associated excavator, wheel-loader backhoe or any other associated machine having an arm and control link to which the coupler C is operatively connected; and, (ii) a lower section L configured or adapted for releasable operative connection to first and second spaced-apart, parallel pins (see pins P1,P2 in FIGS. 12A–12C) that are connected to an associated bucket, shear, grapple, blade or any other associated attachment. The term "parallel" as used herein is intended to mean exactly parallel and slight variations therefrom as caused by tolerances, minor deformation during welding or use, etc.

The upper section U comprises first and second parallel spaced-apart ribs R1,R2 that define an open channel UC therebetween. The first rib R1 comprises first and second spaced-apart bosses S1*a*,S1*b* that define respective first and second bores B1*a*,B1*b*. Likewise, the second rib R2 comprises first and second spaced-apart bosses S2*a*,S2*b* that define respective first and second bores B2*a*,B2*b*. The bores B1*a*,B2*a* and bores B1*b*,B2*b* are aligned with each other and preferably cylindrically defined about respective parallel axes L1,L2. The aligned bores B1*a*,B2*a* are dimensioned for close, sliding receipt of a first associated pin-on pin PO1. The aligned bores B2*a*,B2*b* are dimensioned for close, sliding receipt of a second associated pin-on pin P02. In the illustrated embodiment, the first associated pin-on pin PO1 is used to effect a pivotable pin-on connection between the coupler C and an arm of the associated excavator, backhoe or other machine, while the second associated pin-on pin PO2 is used to effect a pivotable pin-on connection between the coupler C and the control link of the associated excavator, backhoe or other machine. The upper section U, including the ribs R1,R2 and bosses S1*a*,S1*b*,S2*a*,S2*b* (and pins PO1,PO2), is defined from any suitable material(s) known in the art such as various metals and alloys thereof such as steel alloys or the like. The spacing between the ribs R1,R2 and position and size of the bosses S1*a*,S1*b*,S2*a*,S2*b* can vary as required to allow for suitable pin-on connections with the associated machine.

The lower section L of the coupler C comprises first and second hook assemblies H1,H2 that are connected to the upper section U and project outwardly therefrom. Unless otherwise noted, the lower section L and the subassemblies thereof are defined from any suitable material(s) known in the art such as various metals and alloys thereof such as steel alloys or the like. The first hook assembly H1 comprises a first cross-plate XP1 to which first and second rear hook plates K1*a*,K1*b* are connected in parallel spaced-apart relation. The first and second rear hook plates K1*a*,K1*b* define respective recesses RC1*a*,RC1*b* that cooperate to define a first hook FH. A first fill plate FP1 extends between and interconnects the hook plates K1*a*,K1*b*. The fill plate is conformed and dimensioned to cooperate with the recesses RC1*a*,RC1*b* to define the first hook FH.

Thus, the first and second rear hook plates K1*a*,K1*b* and the first fill plate FP1 together define the first hook FH. The first hook FH, as described in further detail below, is conformed and dimensioned to receive a first associated pin P1 (FIGS. 12A–12C) of an associated attachment such as a bucket or blade. The first cross-plate XP1 is preferably fixedly and immovably secured to the ribs R1,R2 and laterally spans the channel UC.

The second hook assembly H2 comprises a second cross-plate XP2 to which first and second front hook plates K2*a*,K2*b* are connected in parallel spaced-apart relation. The first and second front hook plates K2*a*,K2*b* define respective recesses RC2*a*,RC2*b* that cooperate to define a second hook SH. A second fill plate FP2 extends between and interconnects the first and second front hook plates K2*a*,K2*b*, and the second fill plate FP2 is conformed and dimensioned to cooperate with the recesses RC2*a*,RC2*b* in the definition of the second hook SH, i.e., the recesses RC2*a*,RC2*b* and the second fill plate FP2 together cooperate to define the second hook SH.

The second hook assembly H2 further comprises first and second ears E1,E2 and the second cross-plate XP2 extends between and is connected at its opposite ends to the respective ears E1,E2. The ear E1 is pivotably connected to the rib R1 and the ear E2 is pivotably connected to the rib R2. More particularly, the ears define apertures EA1,EA2 that closely rotatably receive the bosses S1*b*,S2*b*, respectively. In some cases it may be desirable to utilize a brass or other bushing located between the ear apertures EA1,EA2 and respective bosses S1*b*,S2*b* to minimize wear and to provide a replaceable wear element. Also, in another alternative embodiment, the bosses S1*b*,S2*b* can, themselves, be provided as or defined by removable and replaceable bushings made of brass or the like (e.g., flanged bushings having enlarged flanges abutted with the ribs R1,R2 and cylindrical bodies extending through the ribs R1,R2 and ears E1,E2, respectively).

Thus, the first and second front hook plates K2*a*,K2*b* and the second fill plate FP2 cooperate to define the second hook SH. The second hook SH, as described further below, is conformed and dimensioned to receive a second associated pin P2 of a bucket, blade or other associated attachment (see FIGS. 12A–12C).

The first hook FH and the second hook SH open outwardly away from each other in generally opposite directions. Because the ears E1,E2 of the second hook assembly SH are pivotably connected to the ribs R1,R2, the second hook assembly H2, including the second hook SH, is movable toward and away from the first hook FH as shown by the arrows A1 in FIGS. 12A–12C and as described further detail below.

The coupler C further comprises mechanical, hydraulic, electro-mechanical and/or other type actuator or means for selective moving the second hook assembly H2 relative to the first hook assembly H1 and for selectively fixedly securing the second hook assembly H2 in a desired select operative position relative to the first hook assembly H1. In the illustrated embodiment, the coupler C comprises a manually driven (or optionally an electro-mechanically or hydraulically driven) screw jack assembly J connected between the second hook assembly H2 and the first hook assembly H1 (or some other fixed part of the coupler C) so that the screw jack assembly J controls the movement and position of the second hook assembly H2 and the second hook SH relative to the first hook assembly H1 and first hook FH. In another embodiment, the screw jack assembly J is replaced by a conventional hydraulic cylinder that extends and retracts axially in response to hydraulic pressure applied in first and second orientations, respectively.

Figure 10A:
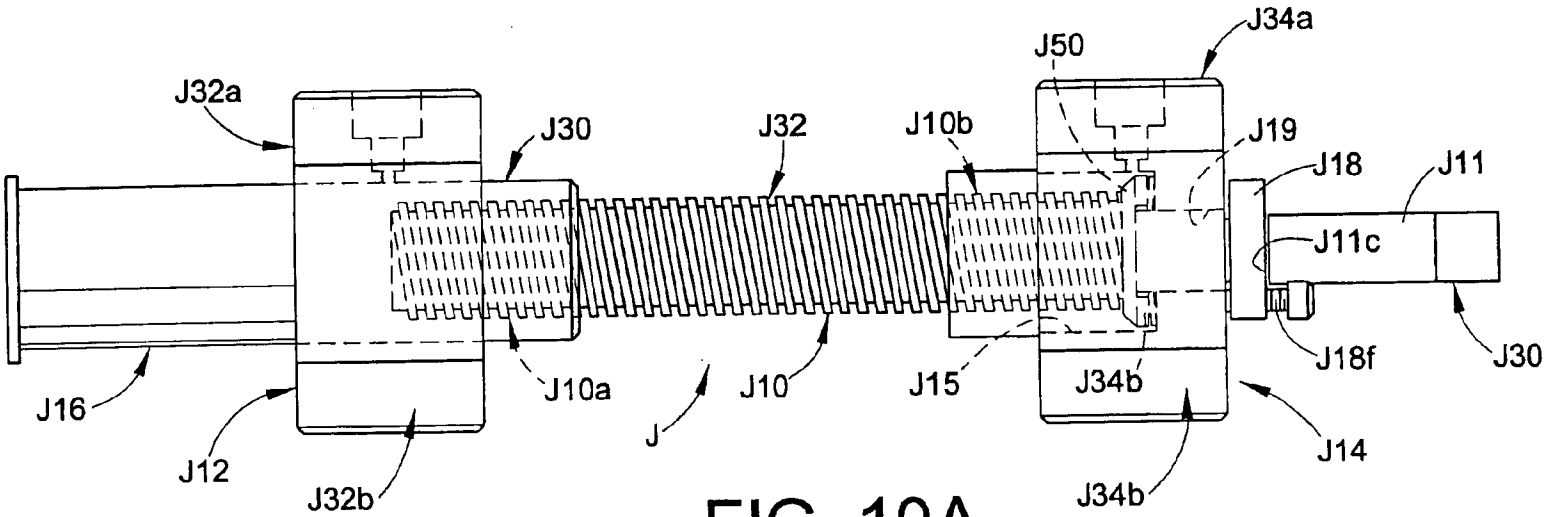
FIGS. 10A & 10B are respective top plan and side views of the screw jack subassembly of the coupler shown in FIGS. 1 & 2.
Figure 10B:
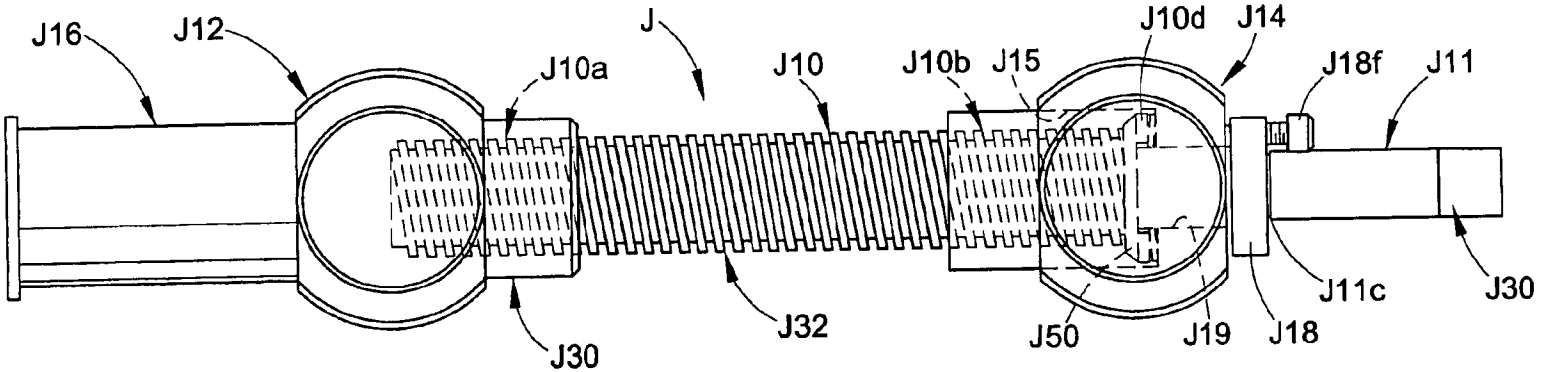
Figure 10D:
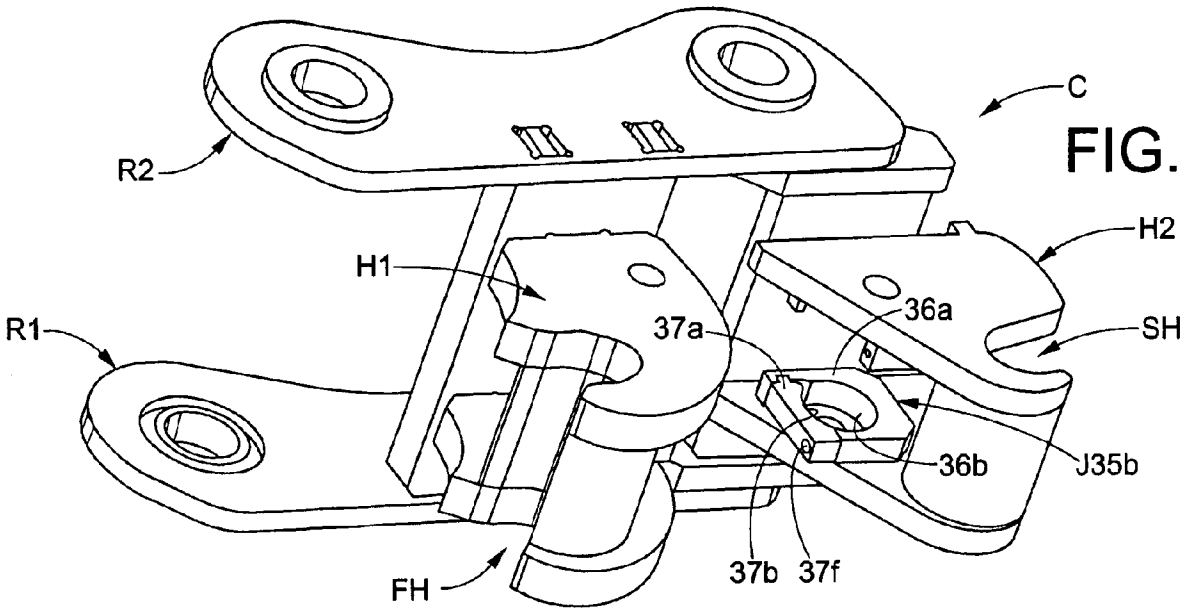
FIG. 10D is a view of the coupler shown in FIGS. 1 & 2 that clearly illustrates a preferred structure for pivotably connecting the screw jack assembly to the first and second hook assemblies.
Figure 10C:
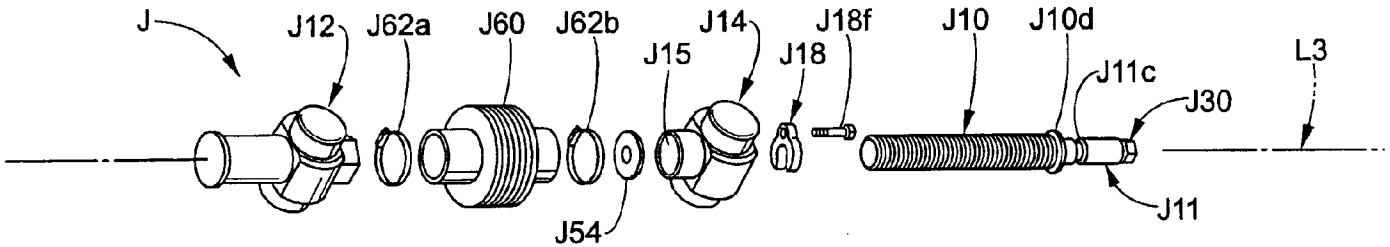
FIG. 10C is an exploded isometric view of the screw jack assembly shown in FIGS. 10A & 10B.

With reference now to FIGS. 10A–10C, the screw jack assembly J comprises a screw member J10 and first and second housing assemblies J12,J14. The first housing assembly J12 is secured to the first hook assembly H1 and the second housing assembly J14 is secured to the second hook assembly H2. The screw member J10 is threaded along at least a portion of its length and extends along a longitudinal axis L3. It is to be noted that in FIGS. 10A, 10B, 12A–12C and 13, certain internal and/or hidden components are illustrated in solid lines rather than broken lines to facilitate understanding of the invention.

The first housing assembly J12 includes an internally threaded nut member or like structure J30 that is threadably engaged with the first end J10*a* of the screw member J10. Thus, the screw member J10 is advanced and retracted relative to the first housing assembly J12 upon rotation of the screw member J10 in first and second directions about the axis L3, respectively. The first housing J12 comprises an enclosed hollow tail or extension J16 that receives and accommodates the portion of the screw member J10 that protrudes through the nut J30 when the screw member is threadably advanced through the nut structure J30. The hollow extension J16 helps to prevent contamination of and damage to the portion of the screw member J10 received therein.

The second end J10*b* of the screw member J10 is connected to the second housing assembly J14 in a manner that allows rotational movement of the screw member J10 about the axis L3 without any threaded engagement between the screw member J10 and the second housing assembly J14. As such, rotation of the screw member J10 does not result in threaded advancement or retraction of the second housing assembly J14 relative to the screw member J20. More particularly, the second housing assembly J14 includes or defines a recess J15 that receives a portion of the second end J10*b* of the screw member J10, and a shank J11 of the screw member projects through an aperture J19 defined in the second housing assembly J14. A removable C-collar J18 or the like is used to secure the screw member J10 to the second housing assembly J14 to prevent axial separation between these two members J10,J14 while allowing the screw member J10 to rotate about its longitudinal axis L3. The C-collar J18 (see also FIG. 8) is positioned axially between the second housing assembly J14 and a shoulder J11*c* of shank J11 and secured to the second housing assembly using a screw or other fastener J18F. The C-collar J18 captures the second housing assembly J14 between itself (the C-collar J18) and an enlarged radial flange J10*d* of the screw member J10 so that the screw member J10 cannot be separated axially from the second housing member J14 (limited axial movement or "play" of the screw member J10 relative to the second housing assembly J14 is allowed and desirable for reasons noted below).

As noted, the first and second housing assemblies J12,J14 are secured respectively to the first and second hook assemblies H1,H2 in the illustrated embodiment. During use of the screw jack assembly to pivot the second hook assembly H2 relative to the first hook assembly H1, limited angular movement between the screw member J10 and the hook assemblies H1,H2 must be accommodated. In the illustrated embodiment, the first housing assembly J12 is pivotably connected to the first hook assembly H1 and the second housing assembly J14 is pivotably connected to the second hook assembly H2.

Figure 7:
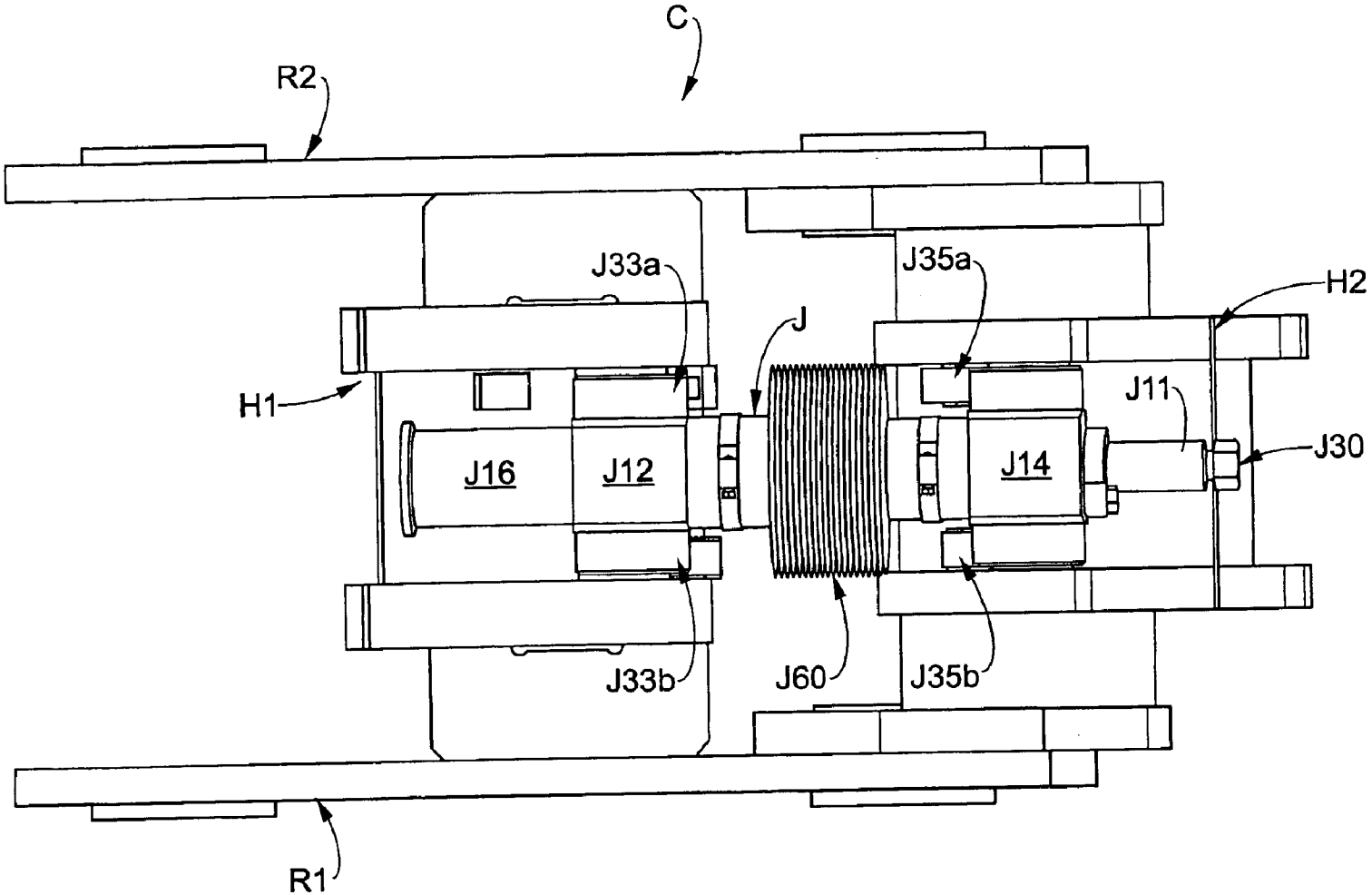

More particularly, as illustrated herein, the first housing assembly J12 comprises first and second cylindrical hubs J32*a*,J32*b* projecting outwardly from opposite lateral sides thereof. These hubs J32*a*,J32*b* are pivotably or rotatably engaged with respective cylindrical hub-receiving portions J33*a*,J33*b* of the first hook assembly H1 as shown in FIG. 7. Likewise, the second housing assembly J14 comprises first and second cylindrical hubs J34*a*,J34*b* projecting outwardly from opposite lateral sides thereof. These hubs J34*a*,J34*b* are pivotably or rotatably engaged with respective cylindrical hub-receiving portions J35*a*,J35*b* of the second hook assembly H2 as shown in FIG. 7. It is preferred that each the hub-receiving portions J33*a*,J33*b*,J35*a*,J35*b* comprise a recess and a keeper that is selectively secured adjacent the recess by a fastener to capture the hub J32*a*,J32*b*,J34*a*,J34*b* adjacent the recess. FIG. 10D shows a suitable arrangement for the hub-receiving portions J33*a*,J33*b*,J35*a*,J35*b* (only the portion J35*b* is visible in FIG. 10D but the others J33*a*,J33*b*,J35*a* are identical). The hub-receiving portion J35*b* comprises a first or base member 36*a* that is connected to or an integral part of the second hook assembly H2 and defines a partially-cylindrical recess 36*b*. A keeper 37*a* defines a partially-cylindrical recess 37*b* and is selectively and releasably connected to the first member 36*a* via fastener 37*f*. It can be seen that the recesses 36*b*,37*b* of the base 36*a* and keeper 37*a* cooperate to define a cylindrical hub-receiving space for the cylindrical hubs J32*a*,J32*b*J34*a*J34*b*.

Figure 8:
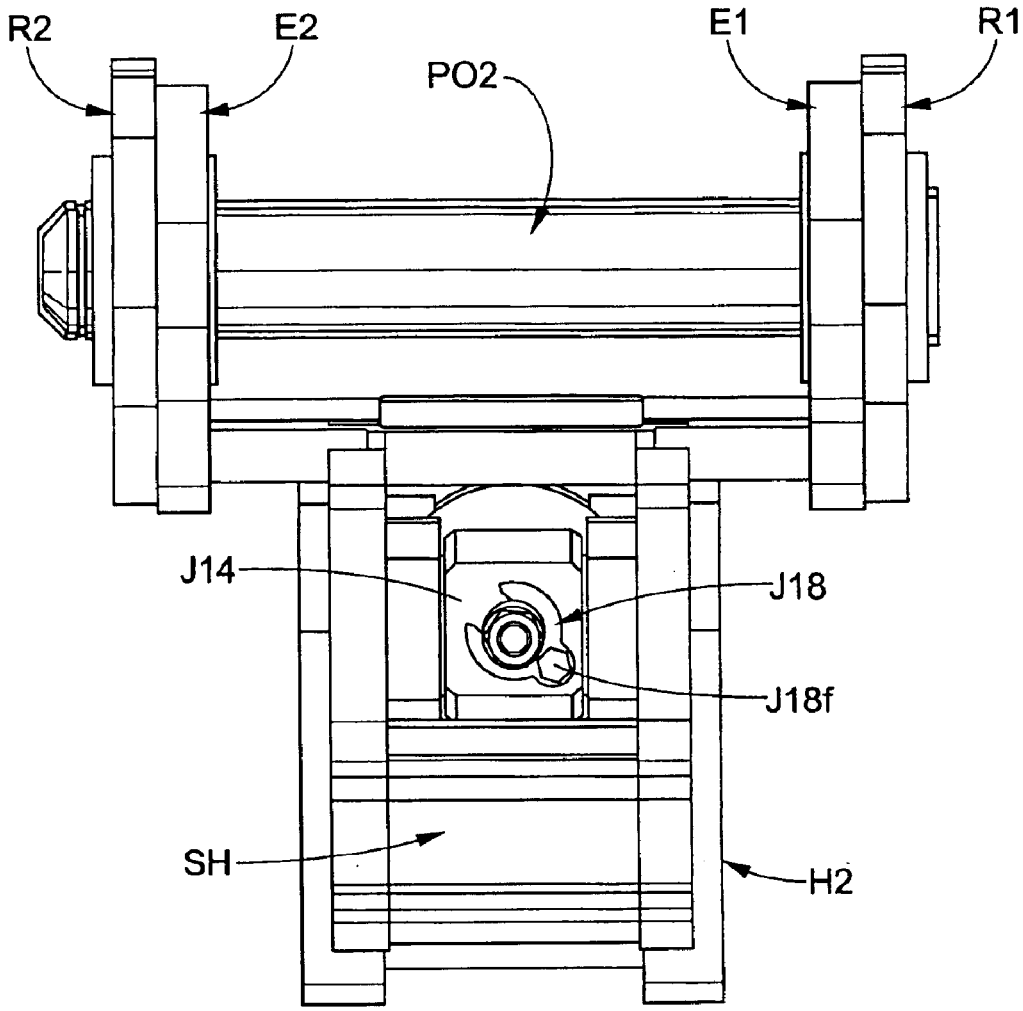
FIGS. 8 & 9 are front and rear views, respectively, of the coupler shown in FIGS. 1 & 2.
Figure 9:
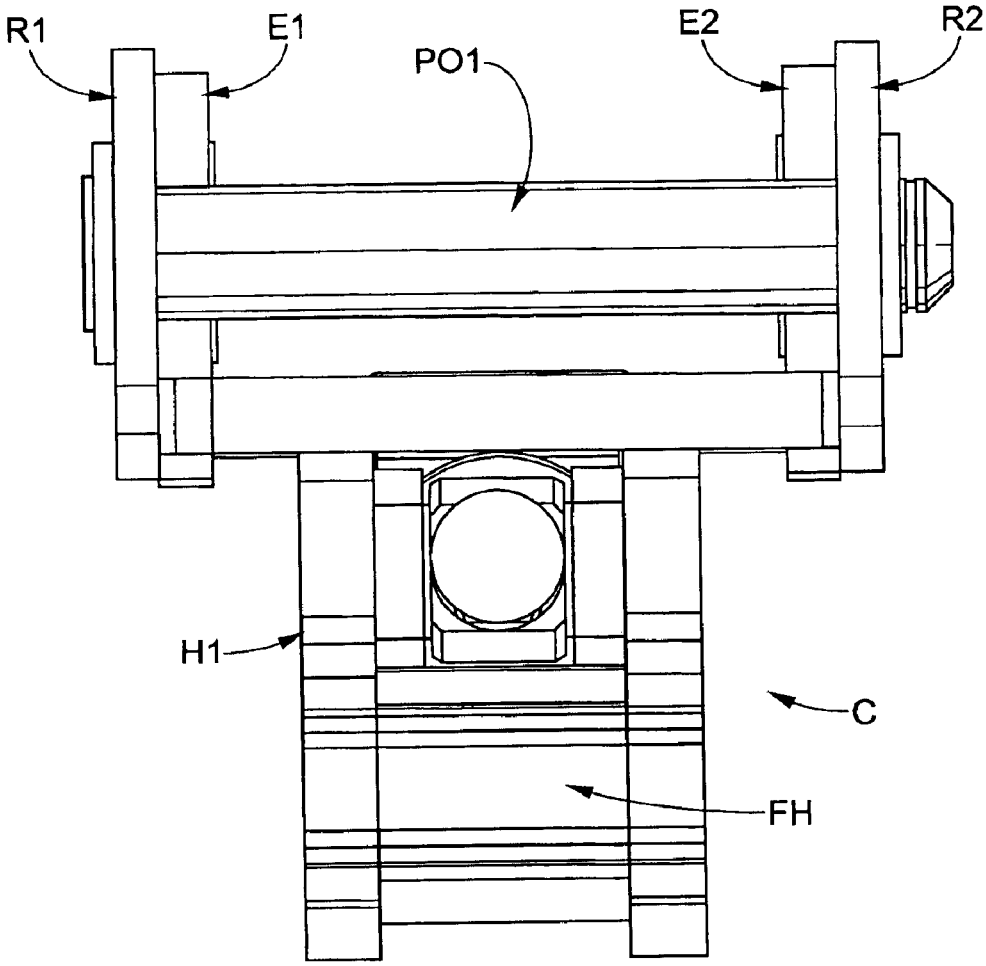

The shank J11 of the screw member J10 comprises a head portion J30 defined as a polygon or other suitable shape for being drivingly engaged by an associated tool (see also FIG. 8). Thus, the screw member J10 is rotatable clockwise and counter-clockwise about its longitudinal axis L3 via torque applied to the head J30 from an associated tool. It is preferred that the screw jack assembly J be configured as shown herein, with the driving head J30 located near the second hook assembly H2 rather than the first hook assembly H1, in that the driving head J30 is easily visible during coupling and decoupling of attachments, although it is not intended that the invention be limited only to the illustrated arrangement.

Figure 12A:
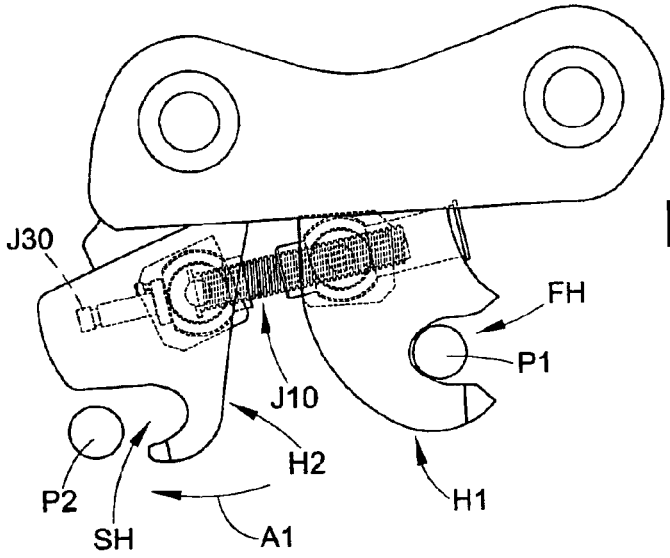
FIGS. 12A–12C are side views of the coupler shown in FIGS. 1 & 2 and respectively illustrate the coupler in first, second and third operative positions relative to two associated pins of an associated bucket or other attachment.
Figure 12B:
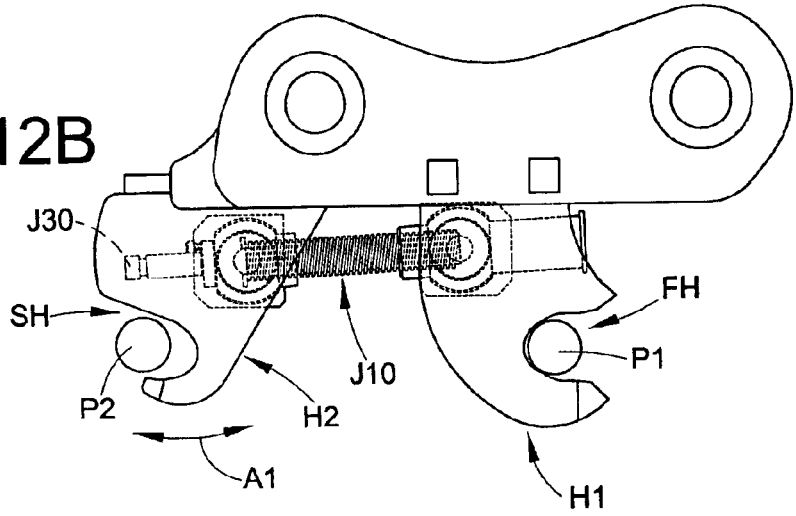
Figure 12C:
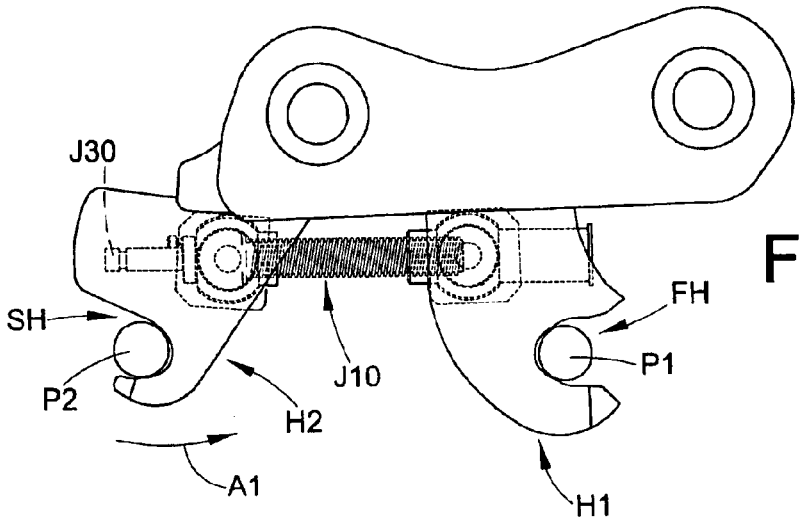

As noted, a wrench or other took is used on the head portion J30 to rotate the screw member J10 as desired to control the position of the front or second hook assembly H2 on the arc A1 (FIGS. 12A–12C) which, in turn, controls the distance between the first hook FH and second hook SH. With reference to FIGS. 12A–12C, the coupler C is used to operatively couple with a bucket or other associated attachment by positioning the first and second hooks FH,SH between first and second pins P1,P2 of the associated attachment, with the first pin P1 fully or partially received in the first recess FH as shown in FIG. 12A. Thereafter, the screw J10 is rotated by a tool acting on the head portion J30 to pivot the second hook assembly H2 on the arc A1 away from the first hook portion H1 so that the second pin P2 of the bucket or other associated attachment moves partially (FIG. 12B) and then fully (FIG. 12C) into the second hook SH. The screw member J10 is rotated still further until both the first pin P1 and second pin P2 are fully and firmly seated in the respective recesses FH,SH so that the associated bucket or other attachment is operatively secured to the coupler C.

The threads J32 on the screw member J10 are designed to inhibit rotation of the screw member J10 under axial loading thereof. For example, in one preferred embodiment, it is preferred that ACME threads be used to achieve this result.

Thus, when the coupler C is in use and loads are exerted on the second hook assembly H2 in a direction toward the first hook assembly H2, the screw member J10 will resist rotation owing to the ACME threads. In one example the screw member J10 is a 1.25 inch diameter screw with ACME threads that are configured as five threads/inch single lead or as otherwise deemed appropriate for the size and rating of the coupler C.

Figure 11:
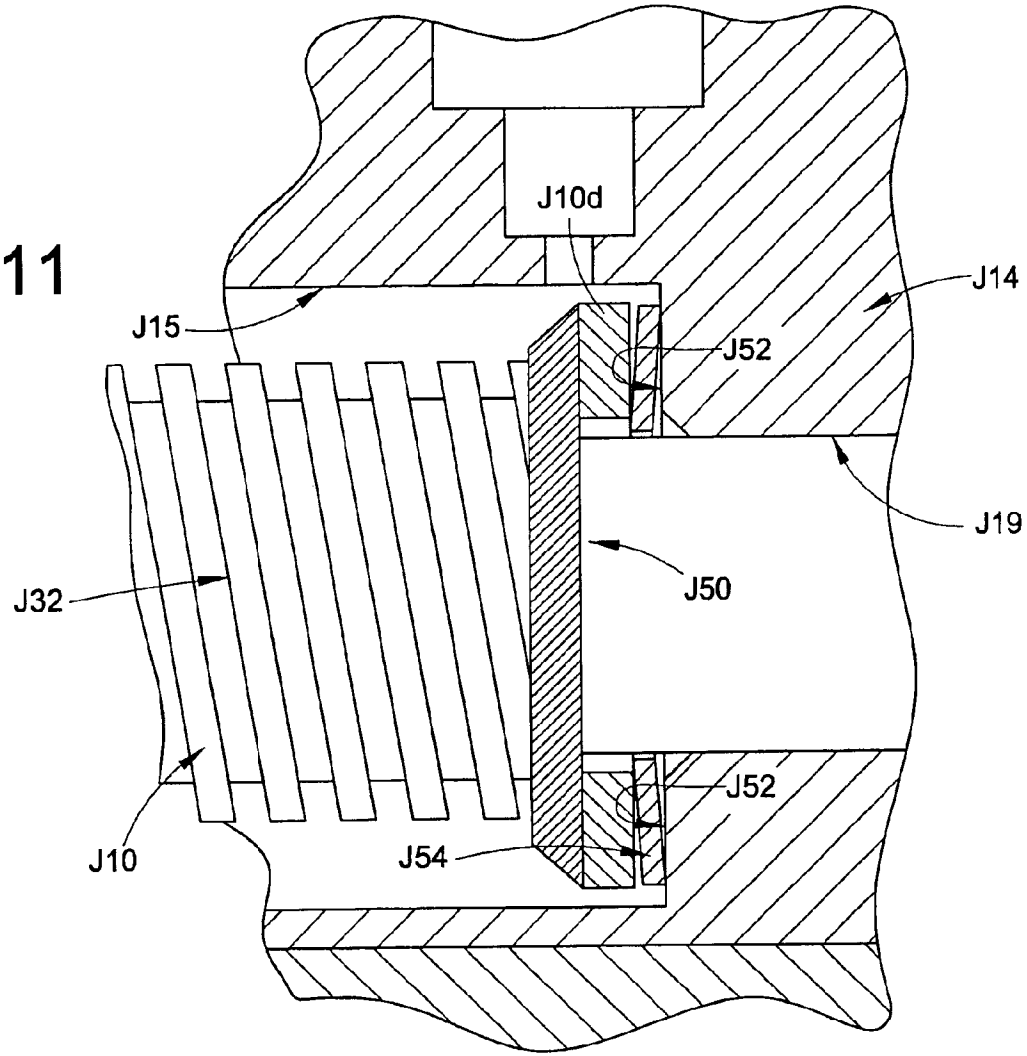
FIG. 11 is a greatly enlarged partial illustration of the screw jack subassembly shown in FIGS. 10A–10C and showing the disc lock mechanism thereof.

As noted above, limited axial movement or "play" is present between the second housing assembly J14 and the screw member J10. This is desirable for operation of a disc lock mechanism J50 that forms a part of the present coupler C. With reference to FIGS. 10A, 10B and 11, the second housing assembly J14 defines an internal bearing wall J52 (see enlarged FIG. 11) that partially defines the recess J15. As noted above, the screw member J10 includes an enlarged radial flange J10*d* located adjacent the bearing wall J52. A Belleville spring/washer or disc spring member J54 is arranged coaxial with the screw member J10 axially between the flange J10*d* and the bearing wall J52, preferably with the concave portion thereof oriented toward the bearing wall J52. The disc spring J54 preferably requires a high force of about 700–800 pounds to be completely compressed or flattened.

In use, rotation of the screw member J10 results in spreading of the second hook assembly H2 away from the first hook assembly H1 as described above, and the disc lock mechanism has no material effect on this initial operation. However, as the first and second hooks FH,SH engage their respective attachment pins P1,P2 and resist further spreading relative to each other, the flange J10*d* and bearing wall J52 are urged forcibly toward each other against the biasing force of the disc spring J54. Upon sufficient rotation of the screw member J10, the disc spring will become partially and, ultimately, fully compressed when the first and second attachment pins P1,P2 are fully and operatively seated in the respective hooks FH,SH. When compressed or partially compressed, the disc spring J54 exerts constant axial forces on the flange J10*d* and bearing wall J52 in opposite axial directions, i.e., the disc spring J54 attempts to urge the flange J10*d* and bearing wall J54 axially away from each other. This axial loading results in high friction at the interface of the flange J10*d* with the disc J54 and also results in high friction at the interface of the disc J54 with the bearing wall J52. These high friction conditions prevent or severely inhibit unintended or free rotation of the screw member J10 during use and, thus, "lock" the screw member J10 in position when the first and second pins P1,P2 are fully and operatively seated in the first and second hooks FH,SH. Those of ordinary skill in the art will recognize that the disc lock mechanism J50 is "touch sensitive" in that it has no meaningful effect on rotation of the screw member J10 until both the first and second hooks FH,SH are at least partially engaged with the respective pins P1,P2. Furthermore, the use of a Belleville spring J54 as described herein is preferred because the spring J54 requires only a very small axial compression or displacement to be fully compressed.

The screw jack assembly J preferably comprises a bellows J60, made from rubber, plastic or the like (see e.g., FIGS. 1–7 and 10C). The bellows J60 is secured at its opposite ends adjacent the first and second housing assemblies J12, J14, respectively, by clamps J62*a*,J62*b* or the like. The bellows J60 encases the screw member J10 between the first and second housing assemblies J12,J14 and lengthens and shortens as required to accommodate different spacing between the housings J12,J14. The bellows J60 prevents or at least inhibits flow of dirt and water to the screw member J10 and the housings J12,J14.

The first hook FH is conformed or defined so that its open mouth J90 (see FIG. 4) is fanned or widely diverging moving outwardly away from an innermost end J94. This shape facilitates insertion of the first attachment pin P1 into the first hook FH. The mouth J90 of the first hook FH is defined between first and second terminal ends J90*a*,J90*b* of the first hook FH, and these first and second terminal ends J90*a*,J90*b* are spaced at least approximately the same distance from the innermost end J94 of the first hook FH. The second hook SH comprises a mouth J92 defined between first and second terminal ends J92*a*,J92*b* of the second hook SH. The second terminal end J92*b* is spaced farther from the innermost end J96 of the second hook SH as compared to the first terminal end J92*a*. Preferably the second terminal end J92*b* is spaced from the innermost surface J96 at least 1.5–2.0 times the distance between the first terminal end J92*a* and the innermost surface J96. The second hook SH thus comprises a smooth guide ramp J98 located opposite the first terminal end J92*a* and that extends outwardly away from the innermost surface J96 toward and into the second terminal end J92*b*. In use during coupling operations, a first attachment pin P1 is received in the first hook FH and the coupler C is then pivoted about the first attachment pin P1 so that the second attachment pin P2 abuts the ramp J98 of the second hook SH. The second hook SH is then pivoted away from the first hook FH as described above so that the second attachment pin P2 slides on the ramp J98 toward the innermost surface J96 and until the second pin P2 is fully received in the second hook SH.

As illustrated, it is preferred that both the first and second hooks FH,SH be defined by multiple arcuate or circular surfaces defined along respective multiple radii. This allows multiple pin diameters for the pins P1,P2 to be accommodated in each hook FH,SH and also increases the contact surface area between each pin P1,P2 and the surfaces defining the hooks FH,SH. As shown, e.g., in FIGS. 1–3 and 5, the first hook FH includes a first surface S1 defined by a first radius centered at a first point, second surfaces S2*a*,S2*b* each defined by a second radius centered at a second point and third surfaces S3*a*,S3*b* each defined by a third radius centered at a third point. In one example, the first radius equals 1.50 inches, the second radius equals 1.75 inches and the third radius equals 2.16 inches. Similarly, the second hook SH includes a first surface T1 defined by a first radius centered at a first point, second surfaces T2*a*,T2*b* defined by a second radius centered at a second point and third surfaces T3*a*,T3*b* defined by a third radius centered at a third point. In one example, the radius defining the first surface T1 is equal to 1.5 inches, the radius defining the second surfaces T2*a*,T2*b* is equal to 1.75 inches and the radius defining the third surfaces T3*a*,T3*b* is equal to 2.0 inches.

Figure 13:
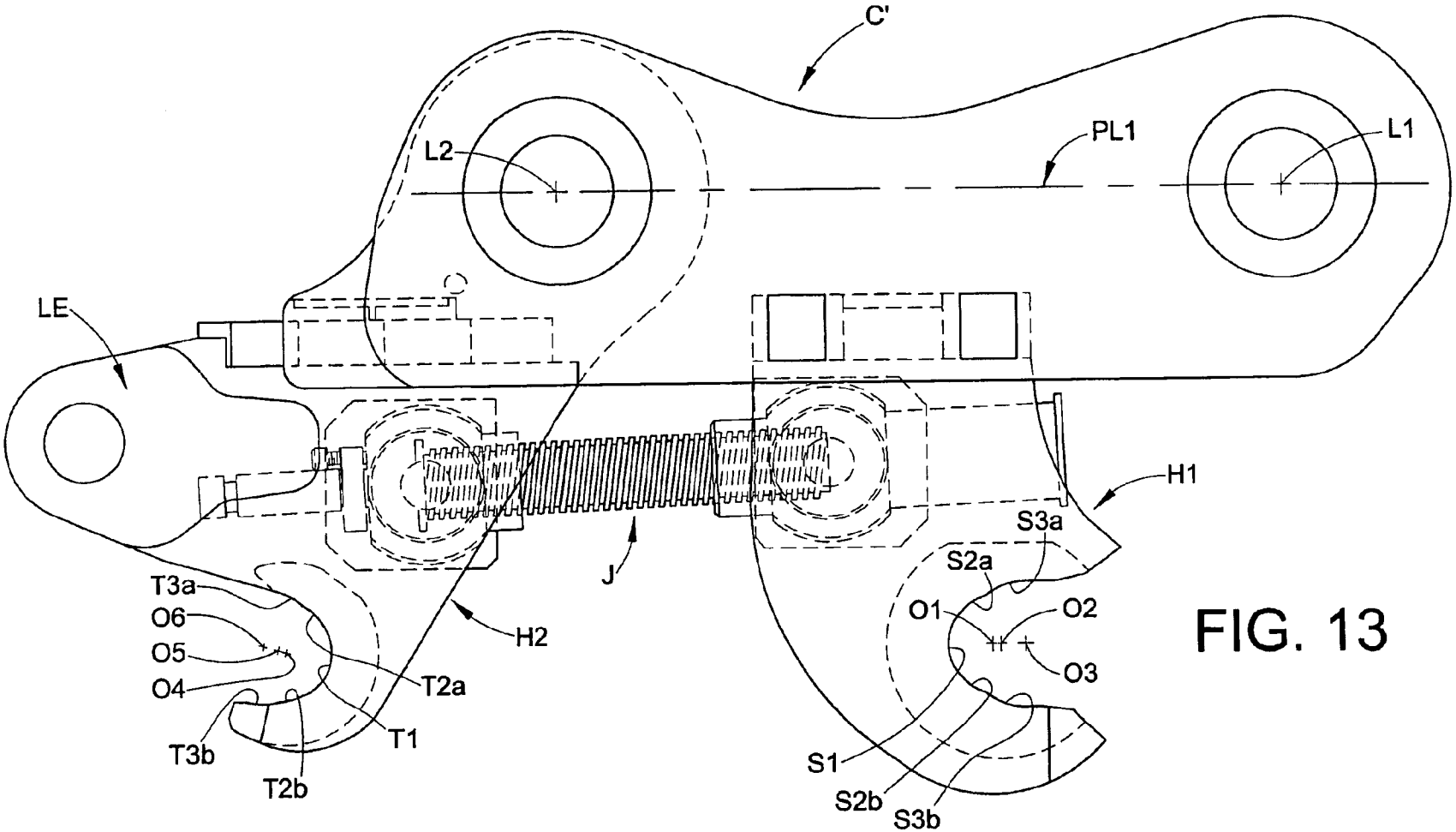
FIG. 13 illustrates an alternative coupler formed in accordance with the present invention.

FIG. 13 illustrates an alternative coupler C' formed in accordance with the present invention. Except as shown and/or described, the coupler C' is identical to the coupler C and FIG. 13 uses reference characters that are identical to those used in FIGS. 1–12C to indicate like parts relative to the coupler C. Unlike the coupler C, however, the coupler C' includes at least one lift eye LE that projects outwardly from the second hook assembly H2.

FIG. 13 also illustrates a preferred construction of the coupler C,C' wherein the surfaces S1; S2*a*,S2*b*; S3*a*,S3*b* are defined by radii centered respectively at O1;O2;O3 and the surfaces T1; T2*a*,T2*b*; T3*a*,T3*b* are defined by radii centered respectively at O4;O5;O6. A line interconnecting the origins O1–O3 is parallel or nearly parallel (within 5 degrees of parallel) to a plane PL1 including the axes L1,L2. On the other hand, when the second hook SH is fully pivoted away from the first hook FH as shown in FIG. 13, a line interconnecting the origins O4–O6 is inclined relative to the plane PL1 so that it intersects the plane PL1 moving away from the first hook FH at an angle of 10 to 20 degrees, preferably about 15 degrees. This arrangement ensures that a second attachment pin P2 will be effectively captured in the second hook SH for all operative positions of the second hook SH, i.e., the line interconnecting the origins O4–O6 will always lie between a position parallel to the plane PL1 and the position shown in FIG. 13 when the first and second attachment pins P1,P2 are fully and operatively seated in the hooks FH,SH for all spacings between the first and second attachment pins P1,P2. This ensures that the second attachment pin P2 will always be effectively captured in the second hook SH even when the second attachment pin P2 is located relatively close to the first attachment pin P1.

Figure 6:
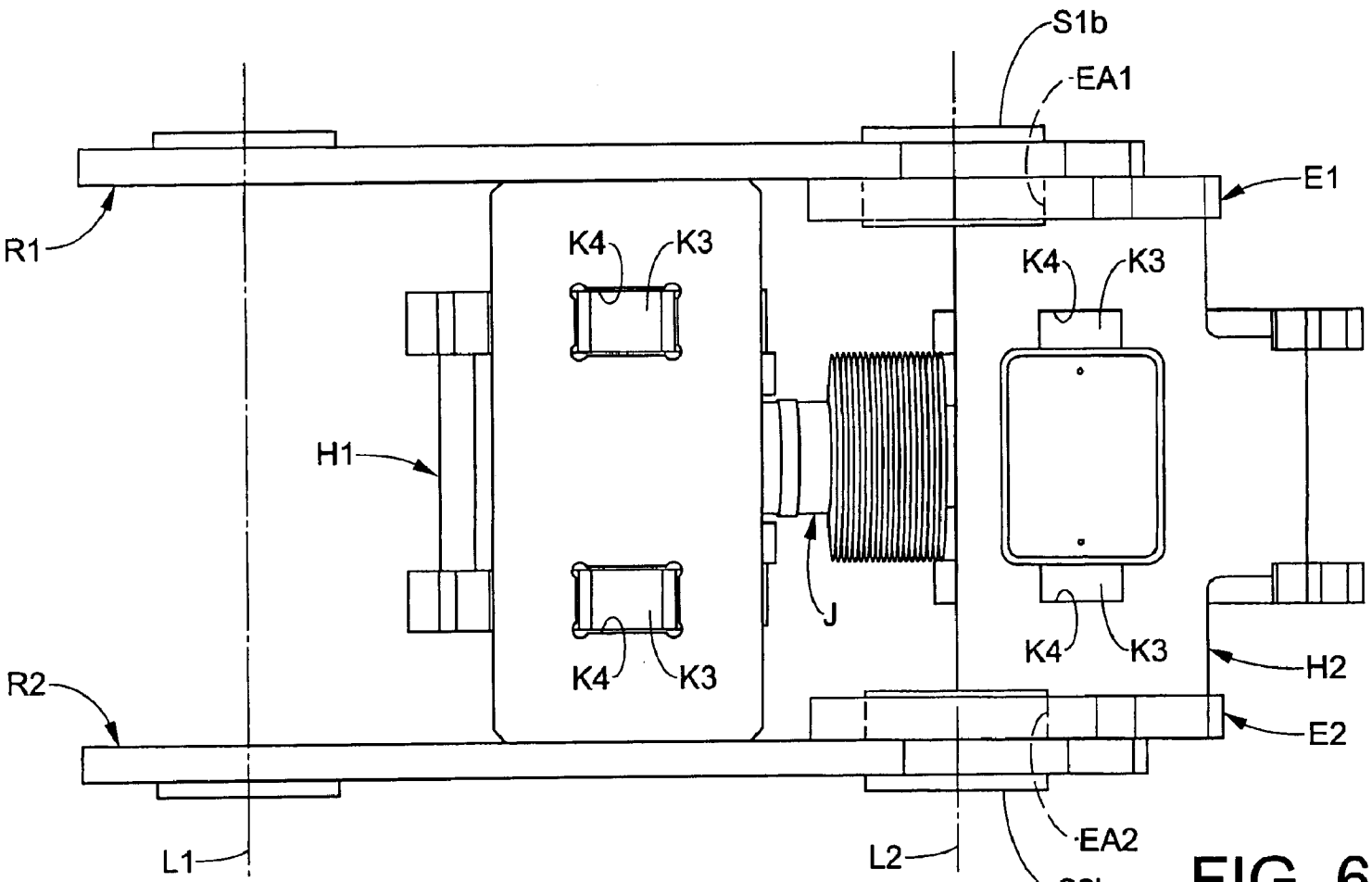
FIGS. 6 & 7 are top and bottom plan views, respectively, of the coupler shown in FIGS. 1 & 2.

It is preferred that the coupler C,C' be constructed so that, whenever possible, a connection of two plates or other components is carried out by insertion of one or more tabs projecting from the first component into corresponding mating slot(s) defined in the second component and then welding the first and second components together. As shown in FIG. 6, for example, the plates K1*a*,K1*b*,K2*a*,K2*b* include tabs K3 that are received in slots K4 defined in the cross-plates XP1,XP2. Also, although they are not all visible, the cross-plates XP1,XP2 include tabs XP3 that are received in slots XP4 defined by the ribs R1,R1 (see, e.g., FIG. 2). This construction technique facilitates construction without a "jig" and also can be used to ensure that parts are not improperly positioned.

The coupler C,C' can include an optional screw jack assembly J' that is identical to the screw jack assembly J, except as otherwise shown and/or described here. Accordingly, like components of the screw jack assembly J' relative to the screw jack assembly J are identified with like reference characters that include a primed (') suffix. New components are identified with new reference characters.

The screw jack assembly J' comprises a screw member J10' and first and second housing assemblies J12',J14'. The first housing assembly J12' is secured to the first hook assembly H1 and the second housing assembly J14' is secured to the second hook assembly H2. The screw member J10' is threaded along at least a portion of its length and extends along a longitudinal axis L3'.

The first housing assembly J12' comprises a first tube member TU1 and the second housing member comprises a second tube member TU2. The first tube member TU1 is telescopically received inside the second tube member TU2 so that the first and second tube members TU1,TU2 cooperate to enclose at least a portion of the screw member J10' that extends between the housing assemblies J12',J14'. A seal JS is connected to the second tube member TU2 and sealingly engages the first and second tube members TU1, TU2 to inhibit entry of water, dirt and other contaminants between these members into the space enclosing at least a portion of the screw J10'.

An internally threaded nut member or like structure J30' is connected to the first tube member TU1 or other portion of the first housing assembly J12' and is threadably engaged with the screw member J10'. Thus, upon rotation of the screw member J10' about the axis L3' the nut member J30' and the first housing assembly J12' are advanced or retracted on the screw member J10' relative to the second housing assembly J14' depending upon the direction in which the screw member J10' is rotated. The tube members TU1,TU2 slidably extend and retract relative to each other but always cooperate to enclose and protect the portion of the screw member J10' extending between the first and second housing assemblies J12',J14'. Advancement of the nut member J30' on the screw member J10' is limited by a first flange stop member ST1 in a first direction and is limited by a second flange stop member ST2 (or by abutment of the tube members TU1,TU2) is a second direction.

The second end J10*b*' of the screw member J10 is connected to the second housing assembly J14' in a manner that allows rotational movement of the screw member J10' about the axis L3' without any threaded engagement between the screw member J10' and the second housing assembly J14'. The second housing assembly J14' includes or defines a recess J15' that receives a portion of the second end J10*b*' of the screw member J10', and a shank J11' of the screw member J10' projects through an aperture J19' defined in the second housing assembly J14'. A clamp J18' or the like is engaged with a circumferential groove of the shank J11' to secure the screw member J10' to the second housing assembly J14' to prevent axial separation between these two members J10',J14' while allowing the screw member J10' to rotate about its longitudinal axis L3'.

Figure 14A:
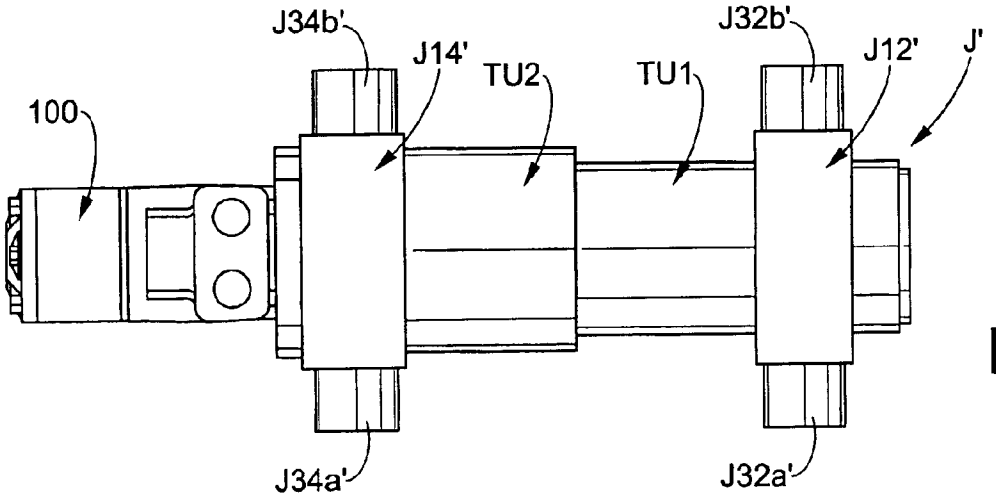
FIGS. 14A and 14B are top plan views of an alternative hydraulic screw jack assembly formed in accordance with the present invention, with the screw jack assembly extended in FIG. 14A and retracted in FIG. 14B; and, FIG. 14C is a sectional view taken along line C—C of FIG. 14B.
Figure 14B:
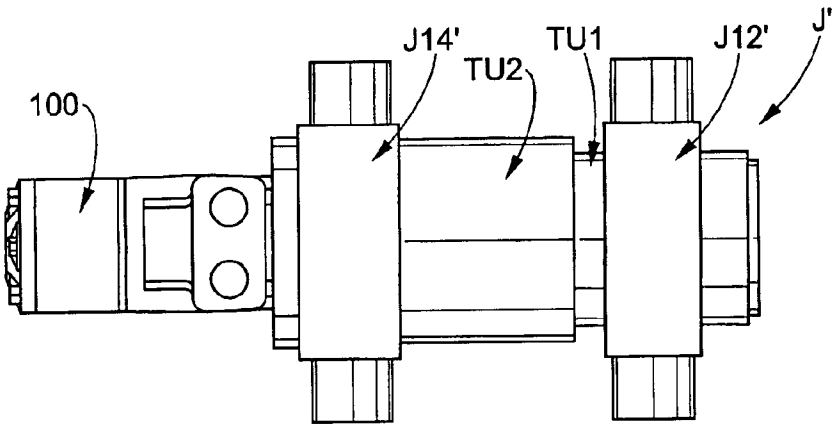
Figure 14C:
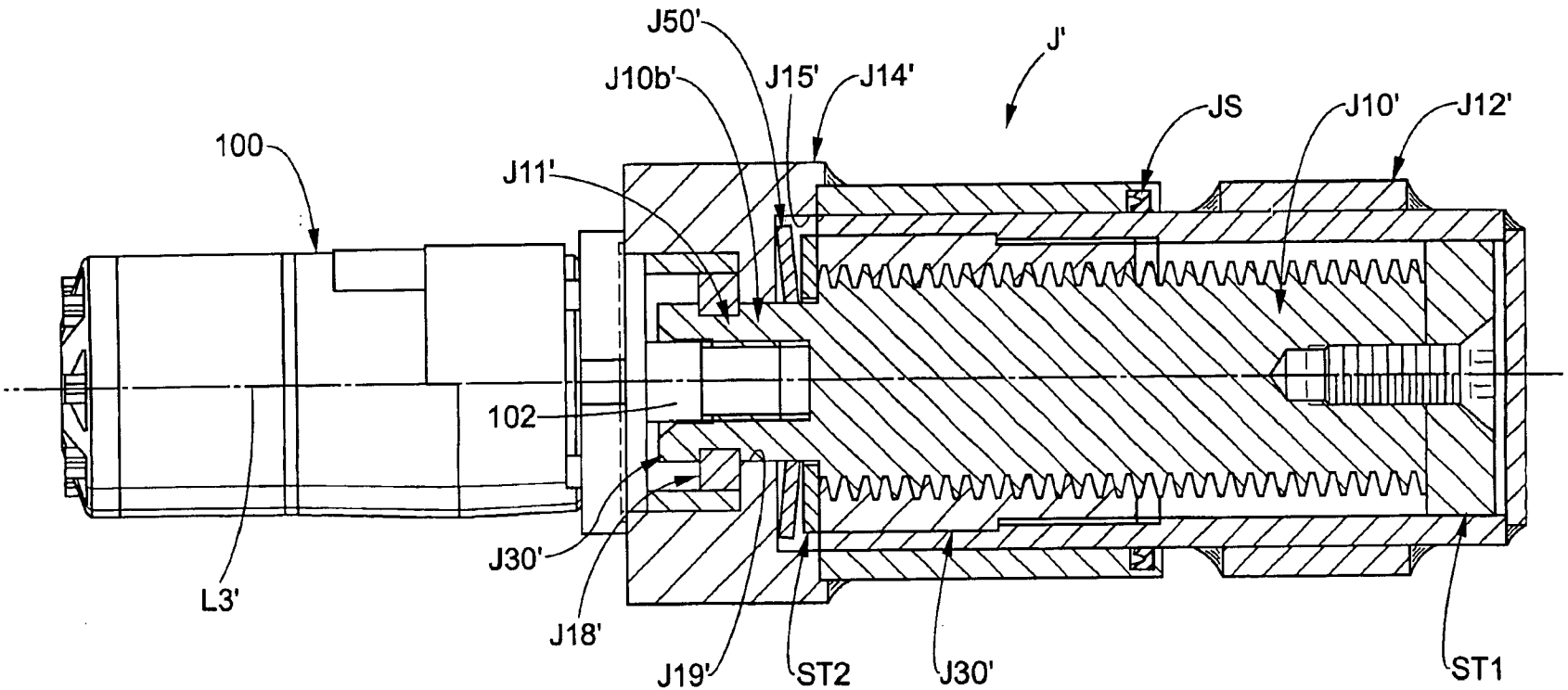

The first housing assembly J12' comprises first and second cylindrical hubs J32*a*',J32*b*' projecting outwardly from opposite lateral sides thereof (FIG. 14A). The second housing assembly J14' comprises first and second cylindrical hubs J34*a*',J34*b*' projecting outwardly from opposite lateral sides thereof (FIG. 14A). The first and second housing assemblies J12',J14' are secured to the first and second hook assemblies H1,H2 in the same manner as described above.

The shank J11' of the screw member J10' comprises a head portion J30' that is drivingly engaged by a output shaft 102 of an associated rotary hydraulic motor 100. Thus, the screw member J10' is rotatable clockwise and counter-clockwise about its longitudinal axis L3' via torque applied to the head J30' by the output shaft 102 of the motor 100. The motor 100 is bolted or otherwise secured to the second housing assembly J14'. In the preferred embodiment, when the motor 100 is bolted to the second housing assembly J14', the motor 100 abuts and holds the clamp J18' in its operative position where the clamp J18' axially secures the screw member J10'.

During use of the coupler C,C' including the screw jack assembly J', the motor 100 is used to selectively rotate the screw member J10' as desired to pivot the second hook assembly H2 relative to the first hook assembly H1. The motor 100 is also used to prevent undesired rotation of the screw member J10' under axial loading of the screw member J10' during use of the coupler. The screw member J10' also preferably utilizes ACME threads as described above for threadably connecting to the nut member J30'. In one example, the screw member J10' is a three inch diameter screw member having single lead ACME threads arranged at four threads/inch.

The screw jack assembly J' also preferably includes a disc lock mechanism J50' that operates in a corresponding manner as described above in relation to the disc lock J50.

The motor 100 is preferably a hydraulic motor operating at about 1250 psi. The motor 100 is pressurized in a first orientation to rotate the output shaft 102 (and screw member J10') in a first direction to spread the second housing assemblies J14' away from the first housing assembly J12'. The motor 100 is pressurized in a second orientation to rotate the output shaft 102 (and screw member J10') in a second direction to draw the second housing assembly J14' toward the first housing assembly J12'. During use of the coupler C,C' with an attachment operatively connected thereto via first and second attachment pins P1,P2 seated in the respective hooks FH,SH, it is preferred that the motor 100 be continuously pressurized in the first orientation to bias or urge the output shaft 102 in the first direction (even though further rotation in the first direction is not possible when the pins P1,P2 are fully seated in the hooks FH,SH) to prevent unintended rotation of the output shaft 102 in the opposite second direction as could lead to decoupling of the attachment from the coupler C,C'. Furthermore, it is preferred that a pilot check valve be used to ensure that the output shaft 102 is rotatable in the second direction only upon the hydraulic motor 100 being actively pressurized in the second orientation with pressure above a select threshold. The use of a pilot check valve in this manner prevents rotation of the output shaft 102 in the second direction upon mere loss of hydraulic pressure in the first orientation due to a cut hose or the like.

The hydraulic fluid used to drive the motor 100 can also serve as a lubricant for the screw member J10'. In this arrangement, hydraulic fluid expelled by the motor 100 or otherwise available to drive the motor is communicated into the space enclosed by the telescoped members TU1,TU2 to lubricate the screw member J10'.

The coupler C,C' including the hydraulic motor 100 is also manually operable in the same manner as the screw jack assembly J simply by removal of the hydraulic motor 100 to allow the screw member J10' to be drivingly engaged, either directly by a mating tool or indirectly through a shaft or adapter. In the latter case, the motor 100 is replaced by a shaft having a first end that drivingly mates with the screw member J10' and a second end that includes or defines a driving head adapted for driving engagement by an associated tool.

It is most preferred that the first hook assembly H1 be fixed relative to the ribs R1,R2 and that the second hook assembly H2 be movable relative to the ribs R1,R2 because the first hook assembly H1, which connects to a first or inner attachment pin P1, will typically encounter higher loads during digging and other operations as compared to the second hook assembly H2. Furthermore, as disclosed herein, it is preferred that the ears E1,E2 of the second hook assembly H2 pivot about the bosses S1*b*,S2*b* through which a pin-on pin PO2 passes so that the second hook assembly H2 pivots about the pin-on axis L2 (or stated another way, the hook assembly H2 pivots about an axis coincident with the pin-on axis L2). This arrangement provides added strength relative to prior designs and minimizes pivot points. The fact that the ears E1,E2 of the second hook assembly H2 pivot about the pin-on axis L2 is also thought to be desirable to save space and provide a preferred geometry relative to prior spread-style couplers.

It is preferred that the first hook assembly H1 be permanently fixed in position relative to the ribs R1,R2 as by welding or the like as disclosed above. However, as used herein, the term "fixed" and other equivalent terms are intended to encompass any other arrangement where the first hook assembly H1 is made immovable relative to the first and second ribs R1,R2 during use of the coupler C,C'. Thus, for example, the term "fixed" as used herein is intended to encompass an arrangement wherein bolts or other fasteners or other means are used to secure the first hook assembly H1 immovably relative to the ribs R1,R2, even if the position of the first hook assembly H1 relative to the ribs R1,R2 is selectively adjustable when the coupler is not in use.

The size of the coupler C,C' will vary depending upon the machine to which it is to be connected and the size of the associated attachments to be operatively engaged by the coupler. For example, the width of the first hook FH and second hook SH can be set to a minimum width for a group or class of attachments. Thus, the coupler C,C' can be operatively coupled to all attachments in the class (spacers can be used between the opposite lateral sides of the hooks FH,SH and the attachment if needed).

Those of ordinary skill in the art will recognize that the second hook assembly H2 can alternatively be pivotable about the first pin-on axis L1 without departing from the overall scope and intent of the present invention. Also, the second hook assembly H2 can be fixed and the first hook assembly H1 pivotable about either the first pin-on axis L1 or second pin-on axis L2.

Modifications and alterations will occur to those of ordinary skill in the art to which the invention pertains upon reading and understanding this specification. It is intended that the invention be construed as including all such modifications and alterations as encompassed by the claims.

Having thus described the preferred embodiments, what is claimed is:

1. A coupler comprising:

first and second spaced-apart ribs each defining first and second bores, said first bore of said first rib aligned with said first bore of said second rib on a first pin-on axis, and said second bore of said first rib aligned with said second bore of said second rib on a second pin-on axis;

a first hook assembly comprising a first hook adapted to receive a first associated attachment pin, said first hook assembly fixed relative to said first and second ribs;

a second hook assembly comprising a second hook adapted to receive a second associated attachment pin, said second hook assembly selectively pivotable relative to said first and second ribs toward and away from said first hook assembly; and an actuator operatively connected to said second hook assembly to pivot said second hook assembly selectively relative to said first and second ribs, wherein said actuator comprises a screw jack assembly including a rotatable screw member comprising a driving head adapted for driving connection with a manual tool.

2. The coupler as set forth in claim 1, wherein said second hook assembly pivots relative to said first and second ribs about said second pin-on axis.

3. The coupler as set forth in claim 1, wherein said first hook assembly is welded in a fixed position relative to said first and second ribs.

4. The coupler as set forth in claim 1, further comprising a hydraulic motor drivingly engaged with said rotatable screw member, said hydraulic motor selectively operable to rotate said rotatable screw member in a first direction in response to hydraulic pressure supplied to said hydraulic motor in a first orientation and selectively operable to rotate said rotatable screw member in a second direction in response to hydraulic pressure supplied to said hydraulic motor in a second orientation.

5. The coupler as set forth in claim 1, wherein said screw jack assembly comprises a first housing assembly connected to said first hook assembly and comprises a second housing assembly connected to said second hook assembly.

6. The coupler as set forth in claim 5, wherein said screw jack assembly further comprises a disc brake assembly comprising a Belleville spring coaxially arranged relative to said rotatable screw member, said Belleville spring selectively compressible when said first and second hook assemblies are engaged with respective first and second associated attachment pins, said Belleville spring, when compressed, frictionally inhibiting relative rotation between one of said first and second housing assemblies and said rotatable screw member.

7. The coupler as set forth in claim 5, wherein said first housing assembly of said screw jack assembly is pivotably connected to said first hook assembly and wherein said second housing assembly of said screw jack assembly is pivotably connected to said second hook assembly.

8. The coupler as set forth in claim 2, wherein said first rib comprises first and second bosses that define said first and second bores of said first rib, and wherein said second rib comprises first and second bosses that define said first and second bores of said second rib.

9. The coupler as set forth in claim 8, wherein said second hook assembly comprises first and second ear members that pivotably interconnect said second hook assembly to said first and second ribs, wherein said first ear is rotatably connected to said second boss of said first rib and said second ear is rotatably connected to said second boss of said second rib.

10. The coupler as set forth in claim 1, further comprising a lift eye defined by one of said first and second ribs.

11. The coupler as set forth in claim 1, wherein said screw jack assembly comprises first and second telescopically interconnected tube members that enclose at least a portion of said rotatable screw member.

12. The coupler as set forth in claim 1, wherein:

said first hook is partially defined by a first set of multiple arcuate surfaces having a first set of different radii centered at a first set of different origins to engage a first set of pin diameters, respectively; and, said second hook is partially defined by a second set of multiple arcuate surfaces having a second set of different radii centered at a second set of different origins to engage a second set of pin diameters, respectively.

13. The coupler as set forth in claim 1, wherein said first hook comprises a first open mouth and a first innermost surface, and wherein said second hook comprises a second open mouth and a second innermost surface, said second open mouth defined between first and second terminal ends of said second hook, wherein said second terminal end is spaced from said second innermost surface by a distance that is at least 1.5 times the distance between said first terminal end and said second innermost surface, said second hook further comprising a guide ramp surface that extends from said second terminal end toward said second innermost surface, said guide ramp adapted to engage and slidably guide the second associated attachment pin into said second hook.

14. A coupler comprising:

an upper portion defining a first pin-on axis and a second pin-on axis;

a first hook assembly comprising a first hook adapted to receive a first associated attachment pin;

a second hook assembly comprising a second hook adapted to receive a second associated attachment pin, said second hook assembly pivotably connected to the upper portion and selectively pivotable about either said first pin-on axis or said second pin-on axis toward and away from said first hook assembly; and an actuator operatively connected to said second hook assembly to pivot said second hook assembly, said actuator comprising a screw jack assembly including a rotatable screw member comprising a driving head adapted for driving connection with a manual tool.

15. A coupler comprising:

an upper portion defining a first pin on axis and a second pin-on axis;

a first hook assembly comprising a first hook adapted to receive a first associated attachment pin;

a second hook assembly comprising a second hook adapted to receive a second associated attachment pin, said second hook assembly pivotably connected to the upper portion and selectively pivotable about said second pin-on axis toward and away from said first hook assembly; and an actuator operatively connected to said second hook assembly to pivot said second hook assembly about said second pin-on axis, wherein said first hook is at least partially defined by a first set of arcuate surfaces that vary relative to each other in terms of radius magnitude and origin location, and said second hook is at least partially defined by a second set of arcuate surfaces that vary relative to each other in terms of radius magnitude and origin location.

16. The coupler as set forth in claim 15, wherein said actuator comprises one of: (i) a screw jack assembly having a rotatable screw member comprising a driving head adapted for driving connection with a manual tool; and (ii) a hydraulic cylinder.

17. The coupler as set forth in claim 15, wherein said first hook comprises a first open mouth and a first innermost surface, and wherein said second hook comprises a second open mouth and a second innermost surface, said second open mouth defined between first and second terminal ends of said second hook, wherein said second terminal end is spaced from said second innermost surface by a distance that is at least 1.5 times the distance between said first terminal end and said second innermost surface, said second hook further comprising a guide ramp surface that extends from said second terminal end toward said second innermost surface, said guide ramp adapted to engage and slidably guide the second associated attachment pin into said second hook.

* * * * *